US010352272B2

(12) United States Patent
Yates et al.

(10) Patent No.: US 10,352,272 B2
(45) Date of Patent: Jul. 16, 2019

(54) DOME FOR A THERMODYNAMIC APPARATUS

(71) Applicant: ThermoLift, Inc., Stony Brook, NY (US)

(72) Inventors: David Yates, Ann Arbor, MI (US); Paul Schwartz, Woodbury, NY (US); Peter Hofbauer, West Bloomfield, MI (US); Adrian Tusinean, Windsor (CA)

(73) Assignee: ThermoLift, Inc., Stony Brook, NY (US)

( * ) Notice: Subject to any disclaimer, the term of this patent is extended or adjusted under 35 U.S.C. 154(b) by 0 days.

(21) Appl. No.: 15/766,813

(22) PCT Filed: Oct. 15, 2016

(86) PCT No.: PCT/US2016/057241
§ 371 (c)(1),
(2) Date: Apr. 7, 2018

(87) PCT Pub. No.: WO2017/066722
PCT Pub. Date: Apr. 20, 2017

(65) Prior Publication Data

US 2018/0283319 A1 Oct. 4, 2018

Related U.S. Application Data

(60) Provisional application No. 62/242,133, filed on Oct. 15, 2015.

(51) Int. Cl.

| | |
|---|---|
| ***F02G 1/055*** | (2006.01) |
| ***F02G 1/057*** | (2006.01) |
| ***F02G 1/053*** | (2006.01) |

(52) U.S. Cl.
CPC ..... *F02G 1/055* (2013.01); *F02G 1/053* (2013.01); *F02G 1/057* (2013.01);
(Continued)

(58) Field of Classification Search
CPC ..... F02G 1/055; F02G 1/057; F02G 1/053; F02G 2243/00; F02G 2243/30; F02G 2254/50
(Continued)

(56) References Cited

U.S. PATENT DOCUMENTS 3,749,079 A 7/1973 Gudman-Hoyer
4,352,269 A * 10/1982 Dineen ..... F02G 1/0435 431/172
(Continued)

FOREIGN PATENT DOCUMENTS

FR 3007077 A1 6/2014

*Primary Examiner* — Hoang M Nguyen
(74) *Attorney, Agent, or Firm* — Diana D. Brehob

(57) ABSTRACT

A thermodynamic apparatus, such as a Stirling engine or a Vuilleumier heat pump, has a heat exchanger in which energy is exchanged between a working fluid and an exhaust gas stream. On top of the cylinder of the thermodynamic apparatus is a dome-shaped section. By incorporating the heat exchanger within the dome, the flow paths can be simplified, the number of separate components reduced, and overall weight reduced. Flow passages for the working fluid are embedded in the dome. Channels for the exhaust gases are formed in an outer surface. The passages and the channels are helically arranged, one clockwise and one counter clockwise. The dome can be cast with a core for the casting fabricated via three-dimensional printing. In some embodiments, the dome is made of fiber-reinforced material.

20 Claims, 3 Drawing Sheets

(52) U.S. Cl.
CPC ..... *F02G 2243/00* (2013.01); *F02G 2243/30* (2013.01); *F02G 2254/50* (2013.01)

(58) Field of Classification Search
USPC ..... 60/517–526
See application file for complete search history.

(56) References Cited

U.S. PATENT DOCUMENTS

| | | | | |
|---|---|---|---|---|
| 5,755,100 | A * | 5/1998 | Lamos | F02G 1/043 60/521 |
| 6,513,326 | B1 | 2/2003 | Maceda | |
| 7,140,959 | B2 * | 11/2006 | Haigh | B60H 1/262 454/136 |
| 2002/0029567 | A1 * | 3/2002 | Kamen | F02G 1/043 60/517 |
| 2013/0220656 | A1 * | 8/2013 | Schwarz | E21B 4/06 173/114 |
| 2014/0207045 | A1 * | 7/2014 | Anand | A61M 27/006 604/9 |
| 2015/0297874 | A1 * | 10/2015 | East | A61M 27/006 604/9 |

* cited by examiner

DOME FOR A THERMODYNAMIC APPARATUS

FIELD

The present disclosure relates to components of thermodynamic apparatuses such as Vuilleumier heat pumps and Stirling engines.

BACKGROUND

A Vuilleumier heat pump (VHP) is a thermodynamic apparatus in which thermal energy from a source, such as a combustor or solar, as well as energy from the environment is extracted to provide heating. The amount of energy available for heating is greater than the amount of fuel energy supplied to the combustor because it is supplemented by the energy from the environment. A VHP can also be used for cooling by extracting the energy from the conditioned air and then dumping excess energy to the environment. A Stirling engine (SE) is a thermodynamic apparatus operating by cyclic compression and expansion of the working fluid at different temperatures, such that there is a net conversion of thermal energy to mechanical work.

Both the VHP and the SE have an energy source (combustor, usually) and a cylinder with one displacer reciprocating with the cylinder in the SE and two displacers in the case of the VHP. VHPs and SEs are closed devices with a working gas at high pressure. The most commonly used working fluids in SEs and VHPs is helium. In many prior art systems, a plurality of tubes that are fluidly coupled to the cylinder extend into the combustion space to effect a transfer of energy from the combustion gases and the working fluid. The brazing of the tubes is a known failure point. With there being so many tubes, ensuring integrity of the system is painstaking. The combination of high pressure and the working gas being a small molecule that passes through materials, even materials such as metals which for most purposes are nonporous, presents challenges. The fewer parts that are coupled together, leak opportunities are reduced. Additionally, it is desirable to integrate several of the apparatuses' components into a single piece for making the device more compact, decreasing weight, decreasing material cost, and decreasing package complexity. Furthermore, it is desirable to supplant the multiple tubes with a more robust architecture.

SUMMARY

To overcome at least one problem in the prior art, a thermodynamic apparatus is disclosed that has a housing with at least a cylinder section into which at least one displacer is disposed and a one-piece dome that couples to the cylinder section. The dome has a plurality of channels on a convex surface of the dome. The dome has a plurality of internal passages defined in the dome. A plurality of orifices is defined on a concave surface of the dome with a first end of the plurality of passages fluidly coupled with an associated orifice. A second end of the plurality of internal passages fluidly couple to a regenerator disposed within the cylinder section.

The combustion apparatus further includes a combustion shell fitted over the dome. A combustion volume is defined between the combustion shell and the dome. A combustor is disposed within the combustion volume. The plurality of channels in the outer surface of the dome are closed off from each other by the combustion shell. In an alternative embodiment, the channels are not grooves on an outside surface of the dome, but are instead fully contained with the dome.

A first end of the plurality of channels is fluidly coupled to the combustion volume and a second end of the channels is fluidly coupled to an exhaust heat exchanger.

A cross-sectional area of each of the plurality of orifices is substantially the same as a cross-sectional area of its associated passage so that neither the orifice nor the passage present a pressure drop that is much higher than the other.

The passages are arranged within the dome in a spiraling fashion. An angle that the passages form with respect to a bottom edge of the dome is related to a total length of the passages.

The channels are arranged on a surface of the dome in a spiraling fashion.

In some embodiments, the passages are arranged within the dome in a spiraling fashion, the channels are arranged on the convex surface of the dome in a spiraling fashion, and one of the passages and the channels spirals counterclockwise and the other of the passages spirals clockwise.

A working fluid is contained within the passages. Exhaust gas flows through the channels. The working fluid is hydrogen, helium, air, methane, ammonia, nitrogen, or any suitable gas. The working fluid shuttles back and forth in the passages in response to the displacer reciprocating within the cylinder section.

The thermodynamic apparatus is one of a Stirling engine and a Vuilleumier heat pump.

In some embodiments, the dome has carbon reinforcing fibers disposed therein.

A unitary or one-piece dome for a thermodynamic apparatus is disclosed. The dome has a plurality of channels on a convex surface of the dome. The dome has a plurality of internal passages defined in the dome. A plurality of orifices is defined on a concave surface of the dome with a first end of the plurality of passages fluidly coupled with an associated orifice. A second end of the plurality of internal passages fluidly couple to a regenerator disposed within the cylinder section.

A cross-sectional area of each of the plurality of orifices is substantially the same as a cross-sectional area of its associated passage.

The passages are arranged within the dome in a spiraling fashion, the channels are arranged on the convex surface of the dome in a spiraling fashion, and one of the passages and the channels spirals counterclockwise and the other of the passages spirals clockwise.

The passages are arranged within the dome in a spiraling fashion. An angle that the passages form with respect to a bottom edge of the dome is related to a total length of the passages.

In some embodiments, the dome material is carbon-fiber reinforced.

Also disclosed is a method to manufacture a dome for a thermodynamic apparatus that includes: fabricating a core for the dome, placing the core into a box having material inside that follows the shape of the outer surfaces of the dome, pouring molten material into the voids in the box, allowing the molten material to solidify to form the dome, removing the material out of spaces within the dome and from the outer surfaces of the dome, and finish machining. The dome has a plurality of channels on an outer, concave surface of the dome. The dome has a plurality of internal passages defined within the dome. A plurality of orifices is defined on a convex surface of the dome with a first end of the plurality of passages fluidly coupled with an associated orifice. The passages are arranged within the dome in a spiraling fashion. The channels are arranged on the surface of the dome in a spiraling fashion. One of the pluralities of passages and the pluralities of channels spiral counterclockwise and the other of the pluralities spiral clockwise.

The box into which the molten material is poured is comprised of two portions that fit together.

In some embodiments, the core is fabricated via a three-dimensional printing technique.

In embodiments with carbon fiber reinforcement, the method further includes: weaving a carbon fiber material and positioning the carbon fiber material into the box prior to pouring in the molten material.

DETAILED DESCRIPTION OF DRAWINGS

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
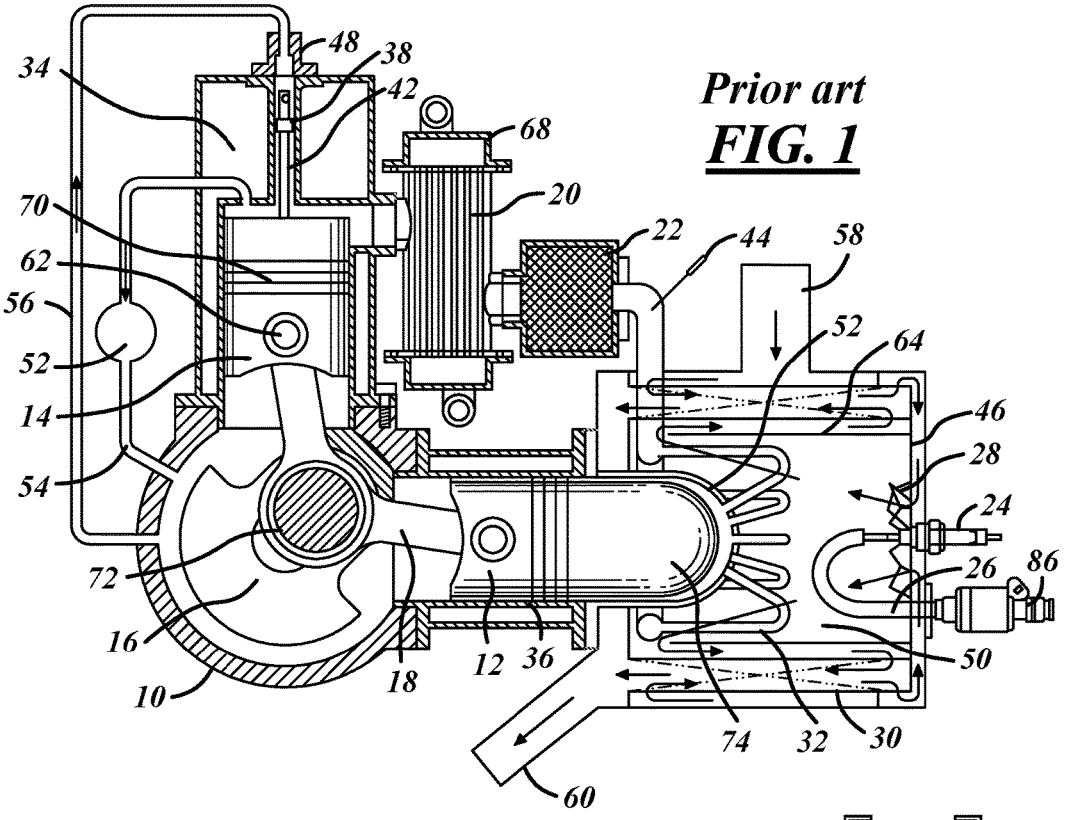
Prior art FIG. 1
FIG. 1 is an illustration of a prior art Stirling engine.

An example of a SE disclosed in U.S. Pat. No. 5,755,100 is shown in FIG. 1. SE has a crankcase 10 which has crank system coupled to a displacer 14 that is used to shuttle the working fluid through the system. The crank 16 also couples to a piston 12 that reciprocates due to gas forces acting upon it. Piston 12 thereby turns crank 16 providing work. The details of the flows through the system will not be discussed herein. To the right of the dome of piston 74 is a volume 50 containing working fluid. Volume 50 is between the dome of piston 74 and a dome 52 associated with the combustor. Fuel and air are supplied through supply 58 with exhaust gases exiting at outlet 60. A spark plug 24 is used as an ignitor to get the combustion going, if a continuous combustion, or intermittently for a cycling combustion. Hot products of combustion in volume 50 transfer energy to a working fluid via a hot heat exchanger, which in this example is a series of tubes 32. When piston 12 moves to the right, working fluid is pushed out into tubes 32 and into a regenerator 22 and then into heat exchanger 20. Flow reverses when piston 12 moves to the left. Tubes 71 are brazed into dome 52 and are susceptible to breakage at the braze joints due to the heat cycling to which they are subjected. In the illustration shown in FIG. 1, 6 tubes are shown. In physical embodiments, it is not unexpected to have 50 to 100 such tubes, which are costly to individually braze in place.

Figure 2:
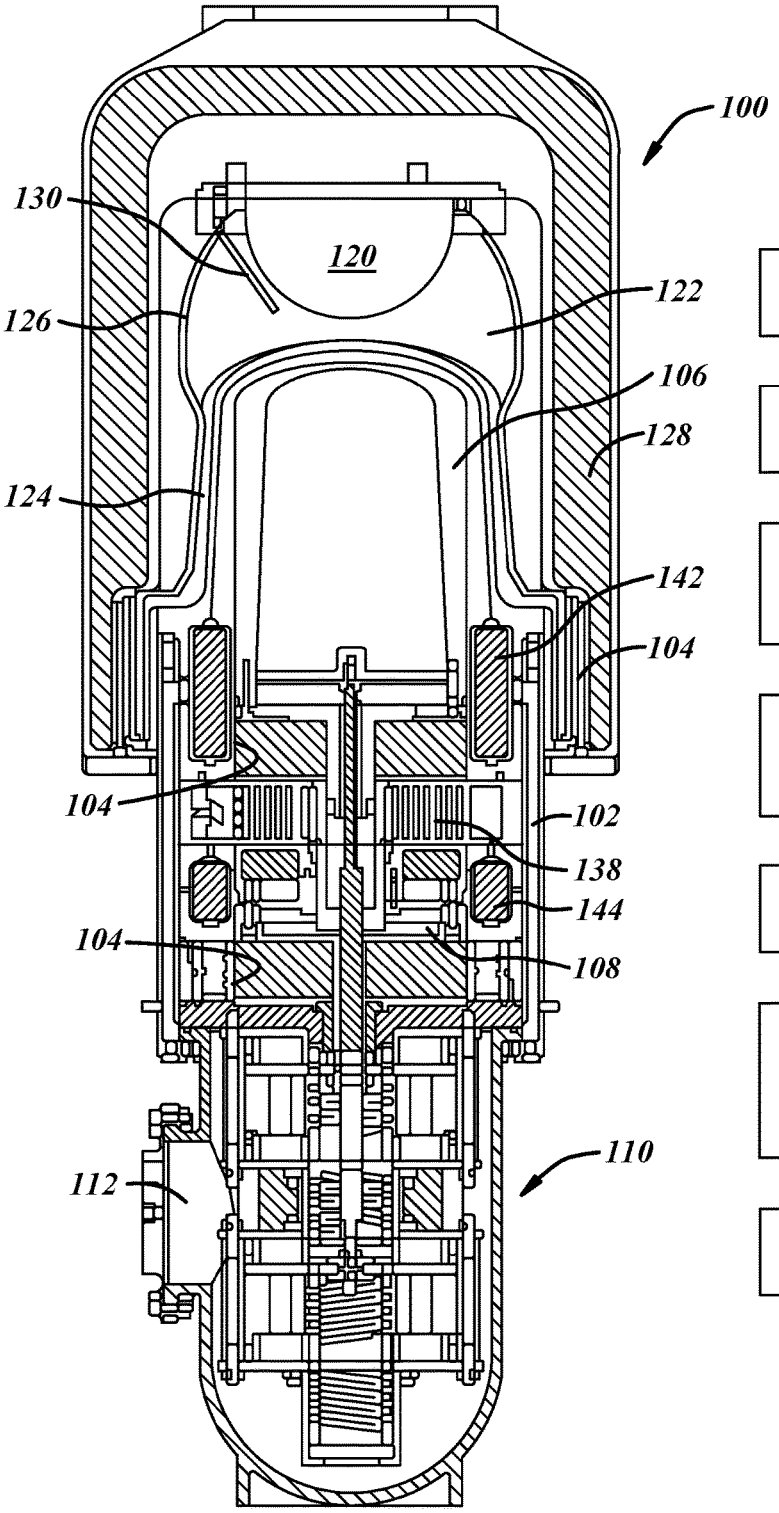
FIG. 2 is an illustration of a heat pump.
Figure 5:
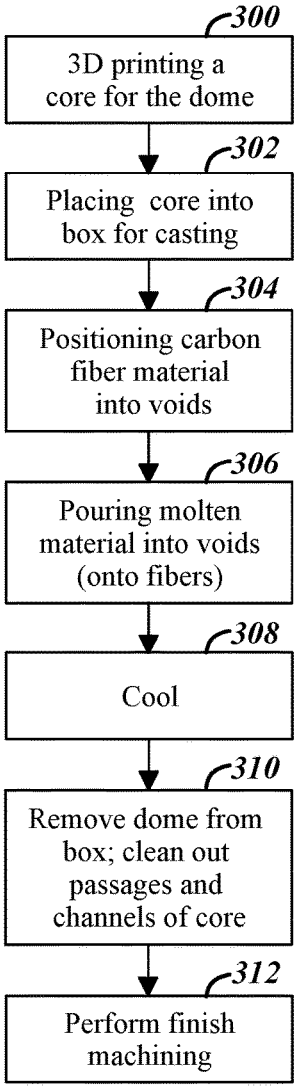
FIG. 5 is a flowchart showing processes to fabricate a dome.

In FIG. 2, an illustration of a Vuilleumier heat pump 100 is shown. Heat pump 100 has a housing that includes several sections. A cylinder housing section 102 has a cylinder wall 104 in which a hot displacer 106 and a cold displacer 108 reciprocate. It is known in the prior art to have a crank driven system for moving displacers. In FIG. 2, a mechatronic system 110 is shown that includes springs, coils, and ferromagnetic blocks upon which the coils act to move displacers 106 and 108. An access panel 112 is provided for the electronics which drive mechatronic system 112.

Heat pump 100 is an example with a combustion energy source. Fuel and air are supplied to a combustor 120. Exhaust from combustor 120 is provided into combustion volume 122 which is contained between a dome 124, which is constructed from multiple pieces, and a combustor shell 126, all of which are housed within combustor housing section 128 that couples with cylinder housing section 102. An ignitor 130 is disposed within combustion volume 122. A heat exchanger 140 is an exhaust-to-intake-air preheater. That is, much of the energy in the exhaust gases is extracted in a heat exchanger, discussed below, that is associated with dome 124. However, some energy remaining in the exhaust gases is used to preheat the inlet air that comes in through heat exchanger 140. Also shown in FIG. 2 are a hot regenerator 142 and a cold regenerator 144.

Figure 3:
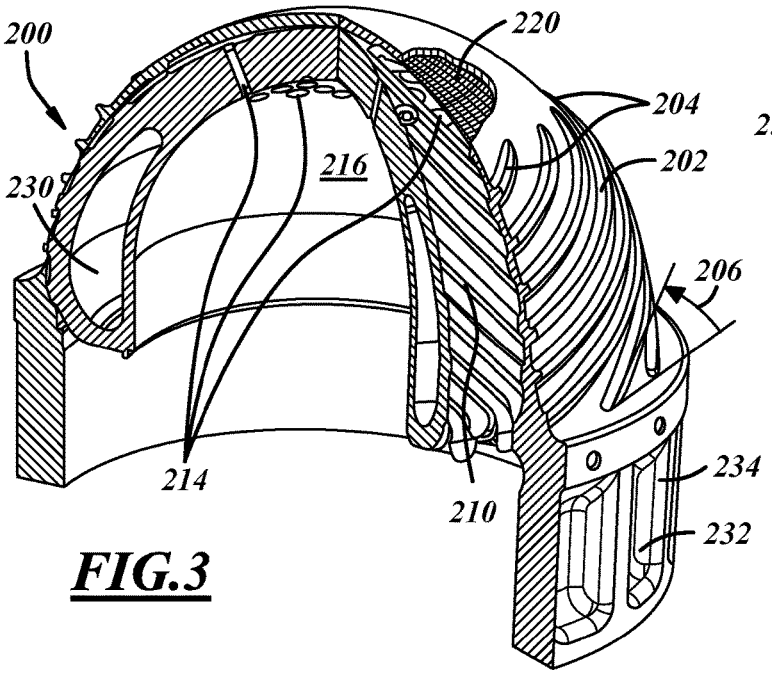
FIG. 3 is a sectioned drawing of a portion of a one-piece dome according to an embodiment of the disclosure.

A one-piece or unitary dome 200 is shown in FIG. 3. Regardless of whether the cutaway representation of dome 200 in FIG. 3 makes it look as if it includes multiple pieces, it is a unitary, cast piece. Alternatively, it could be 3-D printed. Or, in even another alternative, the dome is cast in multiple sections and welded together. Channels 202 are formed on the outside surface of dome 200. A combustor shell (element 126 in FIG. 2, but not shown in FIG. 3) is placed over dome 200. The combustor shell closes off channels 202 from each other. Exhaust gases in combustion volume (122 of FIG. 2) access channels 202 by entrances 204. In an alternative embodiment, channels 202 could be completely enclosed within dome 200 so that the individual channels are closed off from each other without the need of an external piece to cover the channel openings. Channels 202 are arranged helically on dome 200. Alternatively, channels 202 could move down dome 202 vertically. However, to increase the length of travel and hence the heat transfer, it is desirable to angle channels 202. The length of the travel is longer when an angle 206 is small, i.e., shallower rise with respect to horizontal; and shorter when angle 206 is steeper. If one looks at the top of dome 200 and considers channels 202, they are proceeding in a clockwise fashion down dome 200.

Dome 202 also has internal passages 210 through which the working fluid travels. The working fluid shuttles back and forth in internal passages 210. One end of passage 210 is coupled to orifices 214 which fluidly couple the inside 216 of dome 200 and passages 210. The other end of passages 210 lead to a hot regenerator (not shown in FIG. 3). Passages 210 spiral within dome 200 in the opposite direction as channels 202, thus counter clockwise. In one alternative, passages 210 travel straight up dome 200. But, to increase travel to increase heat transfer, a spiral is used. In another alternative, the spiral direction of channels 202 and passages 210 are switched. Voids 230 are provided for weight saving purposes. Similarly gaps 232 are also formed to reduce weight of dome 200. Ribs 234 between adjacent gaps 232 are provided for strength and to provide material for a bolt hole to secure dome 200 to the rest of the heat pump. In some embodiments, dome 202 has a fiber mesh 220 embedded therein.

Figure 4:
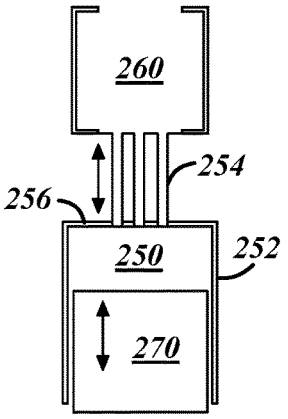
FIG. 4 is a simplified schematic showing the flow path through the dome.

A highly-simplified diagram of the flow through passages 210 of FIG. 3 is shown in FIG. 4. Working fluid 250 is contained within cylinder 252. When a displacer 270 reciprocates upward, working fluid 250 travels through passages 254 into a hot regenerator 260. The working fluid moves beyond hot regenerator 260, but is not discussed further here. When displacer 270 reciprocates downward, fluid from hot regenerator 260 moves into cylinder 252 via passages 254. The working fluid shuttles back and forth as displacer 270 moves up and down. The dome through which orifices lead to passages 254 is represented as 256 in the simplified representation in FIG. 4.

Effective heat transfer is facilitated by increasing the surface area of the passages. This can be accomplished by having many smaller passages as opposed to a few of larger size. A core that is fabricated by 3D printing provides the capability to obtain such small passages within the cast dome, as shown in block 300. The core is place into a box for casting in block 302. Material is placed in the box that conforms to the outside surface of the dome. The box has two parts. In some embodiments, a carbon fiber material is used to reinforce the casting. In such embodiments, the carbon fiber is placed in the voids in a predetermined position, as shown in block 304. In block 306, molten material is poured into the voids, over fibers in embodiments with fibers. In block 308, the molten material is allowed to solidify by cooling down. In block 310, the dome is removed from the box and the core material is cleaned off the outside and cleaned out of the passages. In block 312, finish machining is performed.

Figure 6:
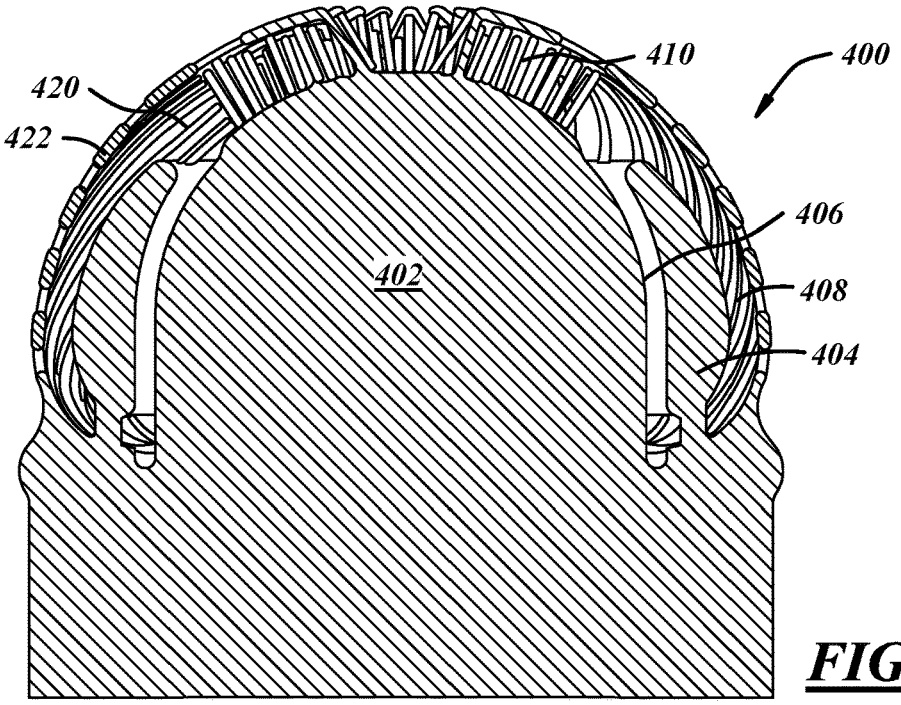
FIG. 6 is a cross-sectional representation of the core material used to cast a dome.

In FIG. 6, a core 400 is shown. The core has a hot chamber core portion 402 and a weight reducing core 404. Voids in core 400 indicate place in the dome that are to be filled with metal. The dome has an inner wall 406 and an outer wall 408. Orifices that run through the dome are shown as cylinders 410. A plurality of passages for the working fluid are shown as elements 420. Grooves on the convex outer surface are shown as elements 422.

Figure 7:
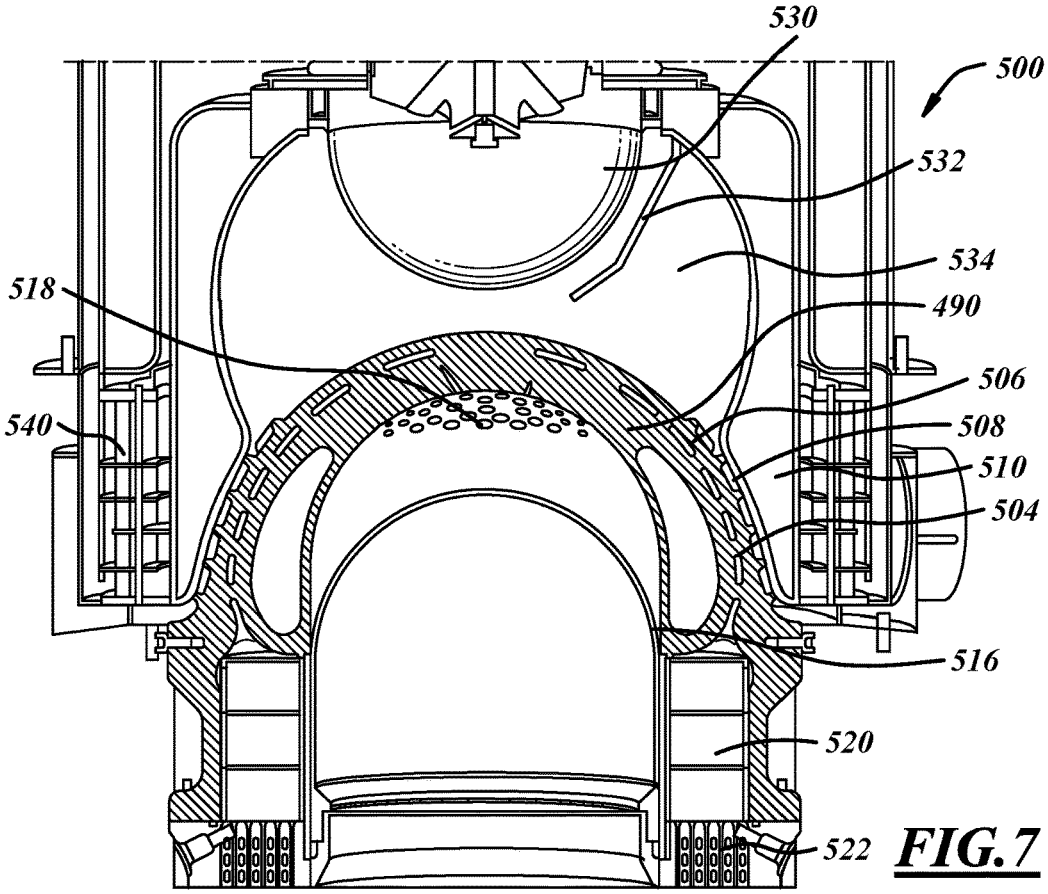
FIG. 7 is a cross-sectional representation of a portion of a heat pump showing a dome according to an embodiment of the disclosure within the heat pump.

In FIG. 7, a dome 490 is shown in context of a portion of a heat pump 500. Dome 490 has a heat exchanger 504 integrated in with passages 506 for the working fluid and channels 508 for the exhaust gases. Channels 508 are closed off from each other by combustion shell 510. A displacer 516 reciprocates: when moving upward, it pushes the working fluid into orifices 518 which are coupled to passages 506 which are in turn coupled to regenerator 520 and heat exchanger 522. The working fluid shuttles through these elements as a result of displacer 516 movement.

A radiation burner 530 is the energy source. Ignitor 532 is the ignition source used for startup. Hot combustion products (or exhaust gases) flow from a combustion volume 534, into channels 508 and from there into an exhaust gas to fresh mixture heat exchanger 540 in which some of the residual energy in the exhaust gas stream is transferred to incoming air or incoming fuel and air for preheat purposes.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art with respect to one or more characteristics are not outside the scope of the disclosure and may be desirable for particular applications.

We claim:

1. A thermodynamic apparatus, comprising:
a housing, comprising:
a cylinder into which at least one displacer is disposed; and
a dome that couples to the cylinder wherein:
the dome has a plurality of channels associated with the dome, the channels being in a substantially dome-shaped arrangement;
the dome has at least one internal passage defined in the dome;
at least one orifice is defined on a concave surface of the dome with a first end of one of the at least one passage fluidly coupled with one of the at least one orifice; and
a second end of the one of the at least one passage is fluidly coupled to a regenerator disposed within the cylinder.

2. The thermodynamic apparatus of claim 1 wherein the housing further comprises:
a combustion shell fitted over the dome wherein:
the plurality of channels is defined in a convex surface of the dome;
a combustion volume is defined between the combustion shell and the dome;
a combustor is disposed within the combustion volume; and
the plurality of channels in the outer surface of the dome are closed off from each other by the combustion shell.

3. The thermodynamic apparatus of claim 2 wherein a first end of the plurality of channels is fluidly coupled to the combustion volume and a second end of the channels is fluidly coupled to an exhaust heat exchanger.

4. The thermodynamic apparatus of claim 1 wherein a cross-sectional area of the at least one orifice is substantially the same that at least one passage to which it is fluidly coupled.

5. The thermodynamic apparatus of claim 1 wherein:
the at least one passage is arranged within the dome in a spiraling fashion; and
an angle that the at least one passage forms with respect to a bottom edge of the dome is related to a total length of the passages.

6. The thermodynamic apparatus of claim 1 wherein the channels are arranged on a convex surface of the dome in a spiraling fashion.

7. The thermodynamic apparatus of claim 1 wherein:
the at least one passage is arranged within the dome in a spiraling fashion;
the channels are arranged on a convex surface of the dome in a spiraling fashion; and
the at least one passage spirals in an opposite sense with respect to the spiral direction of the channels.

8. The thermodynamic apparatus of claim 1 wherein:
a working fluid is contained within the at least one passage;
exhaust gas flows through the channels; and the working fluid is one of hydrogen, helium, air, methane, ammonia, and nitrogen.

9. The thermodynamic apparatus of claim 8 wherein:

the working fluid shuttles back and forth in the at least one passage in response to the displacer reciprocating within the cylinder.

10. The thermodynamic apparatus of claim 1 wherein the dome has woven carbon reinforcing fibers disposed therein.

11. The thermodynamic apparatus of claim 1 wherein the thermodynamic apparatus is one of a Stirling engine and a Vuilleumier heat pump.

12. A one-piece dome for a thermodynamic apparatus wherein:

the dome has a plurality of channels on a convex surface of the dome;

the dome has a plurality of internal passages defined in the dome;

a plurality of orifices is defined on a concave surface of the dome with a first end of the plurality of passages fluidly coupled with an associated orifice; and a second end of the plurality of internal passages fluidly couple to a regenerator disposed within a housing.

13. The dome of claim 12 wherein a cross-sectional area of each of the plurality of orifices is substantially the same as a cross-sectional area of its associated passage.

14. The thermodynamic apparatus of claim 12 wherein:

the passages are arranged within the dome in a hemispherically spiraling fashion; and the channels are arranged on the convex surface of the dome in a hemispherically spiraling fashion; and one of the pluralities of the passages and the pluralities of the channels spirals counterclockwise and the other of the pluralities spirals clockwise.

15. The dome of claim 12 wherein:

the passages are arranged within the dome in a hemispherically spiraling fashion; and an angle that the passages form with respect to a bottom edge of the dome is related to a total length of the passages.

16. The dome of claim 12 wherein the dome is comprised of a carbon-fiber reinforced material.

17. A method to manufacture a dome for a thermodynamic apparatus, comprising:

fabricating a core for the dome;

placing the core into a box having material inside that follows the shape of the outer surfaces of the dome;

pouring molten material into the voids in the box;

allowing the molten material to solidify to form the dome;

removing the material out of spaces within the dome and from the outer surfaces of the dome; and finish machining wherein:

the dome has a plurality of channels on an outer, concave surface of the dome;

the dome has a plurality of internal passages defined within the dome;

a plurality of orifices is defined on a convex surface of the dome with a first end of the plurality of passages fluidly coupled with an associated orifice;

the passages are arranged within the dome in a hemispherically spiraling fashion; and the channels are arranged on the surface of the dome in a hemispherically spiraling fashion; and one of the passages and the channels spiral counterclockwise and the other of them spiral clockwise.

18. The method of claim 17 wherein the box is comprised of two portions that fit together.

19. The method of claim 17 wherein the core is fabricated via a three-dimensional printing technique.

20. The method of claim 17, further comprising:

weaving a carbon fiber material; and positioning the carbon fiber material into the box prior to pouring in the molten material.

* * * * *